United States Patent [19]

Waterman

[11] Patent Number: 4,695,766

[45] Date of Patent: Sep. 22, 1987

[54] TRAVELING WAVE TUBE AND ITS METHOD OF CONSTRUCTION

[75] Inventor: John K. Waterman, Newton, Mass.

[73] Assignee: Raytheon Company, Lexington, Mass.

[21] Appl. No.: 892,018

[22] Filed: Aug. 1, 1986

[51] Int. Cl.[4] ..... H01J 25/34

[52] U.S. Cl. ..... 315/3.5; 315/3.6; 331/157

[58] Field of Search ..... 315/3.5, 3.6; 331/157

[56] References Cited

U.S. PATENT DOCUMENTS 4,129,803 12/1978 Friz ..... 315/315

4,263,566 4/1981 Guenard ..... 315/3.5

FOREIGN PATENT DOCUMENTS 521617 10/1976 Bulgaria ..... 315/3.5

*Primary Examiner*—Harold Dixon

*Attorney, Agent, or Firm*—Martin M. Santa; Richard M. Sharkansky

[57] ABSTRACT

A traveling wave tube made in accordance with this invention wherein the folded waveguide interaction circuit and the input/output transitions to standard waveguides are made of a single piece of metal such as oxygen-free, high conductivity copper. By manufacturing the folded waveguide circuit and the input/output circuit-to-standard waveguide transition out of one piece of material, VSWR on the order of 1.1:1 is expected for traveling wave tubes intended to operate at 94 GHz. Furthermore, this invention minimizes expensive tooling and labor while providing a higher yield of traveling wave tubes.

19 Claims, 16 Drawing Figures

TRAVELING WAVE TUBE AND ITS METHOD OF CONSTRUCTION

BACKGROUND OF THE INVENTION

This invention relates to traveling wave tubes of the folded waveguide type for use at very high frequencies, frequencies in the 100 GHz band where the dimensions of the waveguide are so small that special machining techniques are required to provide a structure which will have electrical characteristics which are required to allow the traveling wave tube to function properly. Prior to this invention, the folded waveguide interaction circuit of the traveling wave tube and the input-/output transitions to standard waveguide, type WR-10 for the 100 GHz range, were made of separate pieces. The fabrication of traveling wave tubes from these component parts by aligning the parts and subsequently brazing the parts to provide an integral unit was particularly difficult to do in the 94 GHz band where the internal circuit folded waveguide cross-section is only 0.010 inches by 0.07 inches. Any misalignment, even of 0.001 inches, causes severe VSWR reflection at the junction between the folded waveguide circuit and the input/output transitions. In actual construction of a 44 GHz folded waveguide traveling wave tube, a minor misalignment at the folded waveguide circuit-to-transition braze resulted in a VSWR of nearly 3 to 1. For the traveling wave tube intended for operation at 44 GHz, the internal circuit folded waveguide dimensions are 0.025 inches by 0.144 inches. Obviously, the problem of alignment and brazing of the folded waveguide circuit and the transition is much more severe for traveling wave tubes intended to operate at 94 GHz.

SUMMARY OF THE INVENTION

The aforementioned problems are overcome and other objects and advantages are provided by a traveling wave tube made in accordance with this invention wherein the folded waveguide interaction circuit and the input/output transitions to standard waveguides are made of a single piece of metal such as oxygen-free, high conductivity copper or aluminum oxide powder dispersion strengthened copper. By manufacturing the folded waveguide circuit and the input/output circuit-to-standard waveguide transition out of one piece of material, VSWR on the order of 1.1:1 is expected for traveling wave tubes intended to operate at 94 GHz. Furthermore, this invention minimizes expensive tooling labor while providing a higher yield of traveling wave tubes.

BRIEF DESCRIPTION OF THE DRAWINGS

The aforementioned aspects and other features of the present invention will be apparent from the following description taken in conjunction with the accompanying drawings wherein.

DESCRIPTION OF THE PREFERRED EMBODIMENT

Figure 1:
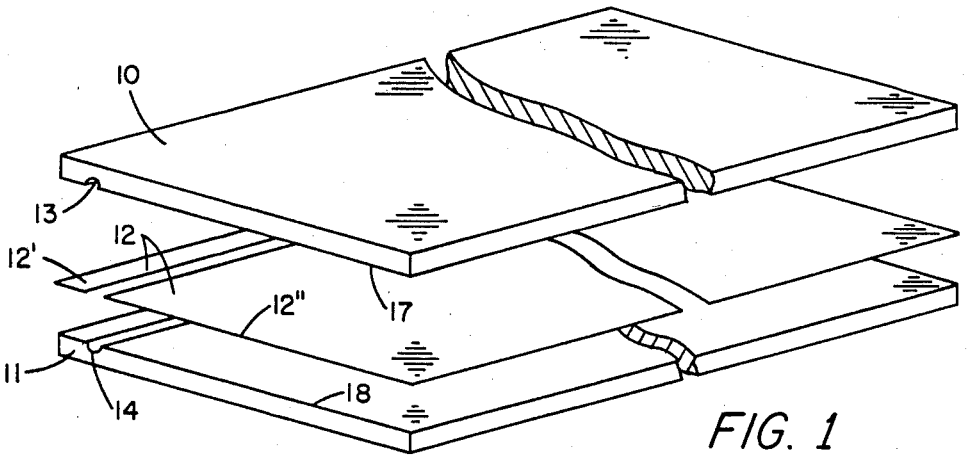
FIG. 1 is an exploded isometric view of the circuit blocks and gold foil prior to brazing.

Referring to FIG. 1, there is shown an exploded view of upper and lower circuit blocks 10, 11, respectively, prior to being subsequently brazed together using the gold foil 12. The brazing is a diffusion braze. Prior to being bonded together, the blocks 10, 11 are polished and a groove 13, 14, respectively, is machined in the blocks 10, 11 by the sinking electric discharge machining method. This technique of making the grooves 13, 14 guarantees surface finishes and straightness at the expense of perfect roundness of the electron beam tunnel 15, shown in the brazed assembly 16 of FIG. 2. The brazing to form assembly 16 comprises heating the assembly 16 to 950° C. for one-half hour at a pressure of 2 pounds per square inch. Prior to the brazing step, the circuit blocks 10, 11 have the surface 17, 18, respectively, which are in contact with the gold foil 12 polished to an eight micro-inch finish. Prior to being brazed, the blocks 10, 11 should be tested for voids and cracks by x-ray, density, magnaflux, and ultrasonic microscope. The electron beam tunnel 15 and the preceding grooves 13, 14 should be tested for straightness before the brazing operation. Typical dimensions of the assembly 16 is a length of 10 inches, a thickness of 0.25 inches, a width of 3.5 inches, with the diameter of the electron beam hole 15 being 0.02 inches.

Figure 2:
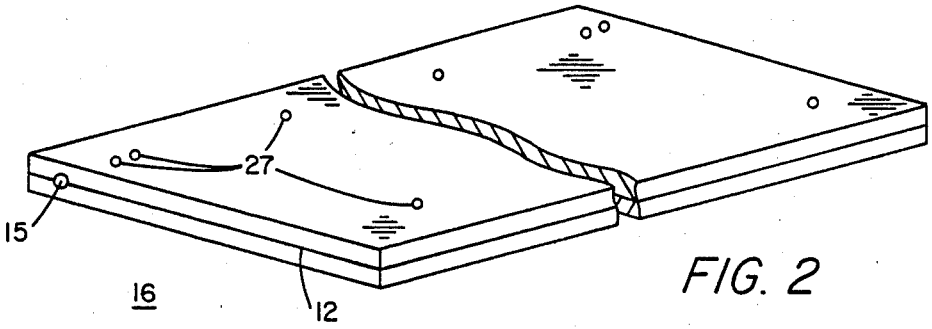
FIG. 2 is an isometric view of the brazed assembly of the components of FIG. 1.
Figure 3:
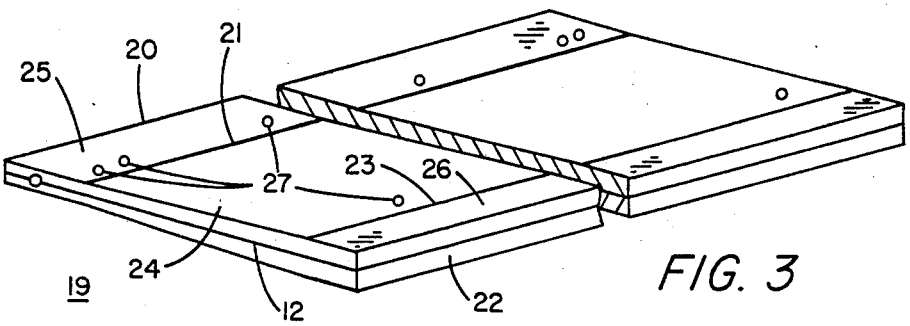
FIG. 3 is an isometric view of the brazed assembly of FIG. 2 after machining.

The assembly 16 of FIG. 2 is next machined to form the assembly 19 of FIG. 3 by grinding both sides of the circuit blocks 10, 11 to a total thickness of 0.0695 inches for a distance from the edge 20 to the line 21 of one inch. The other end 22 of the assembly 19 is ground down to 0.1 inches for a distance of 0.25 inches measured from the edge 22 to the line 23. The region 24 between the lines 21, 23 is a planar tapered-thickness transition between the tunnel region 25 and the region 26 near the end 22. The surfaces 24, 25 and 26 should have an 8 micro-inch finish on both sides of the composite assembly 19 and the surface should be equidistant from the center line formed by the gold foil 12.

FIG. 3 shows an isometric view of the composite assembly 19 after the preceding machining has taken place. The machining should preferably be a grinding process which is capable of producing the desired degree of flatness and surface finish. Also shown in FIGS. 2 and 3 are alignment holes 27 which are drilled holes 1/16 of an inch in diameter which may be drilled through the composite 16 of FIG. 2 before the grinding operation or may be drilled in the composite assembly 19 of FIG. 3 after the grinding operation. These alignment holes are used in the steps of the construction of the slow-wave structure of the invention.

The brazed assembly 16 of FIG. 2 can alternately be constructed following the process more fully described in U.S. Pat. No. 4,129,803. The part 16 without the gold foil 12 is vacuum cast in a ceramic mold with a steel wire of the appropriate diameter forming the beam tunnel 15. The steel wire is made taut by a weight attached to the wire and located external to the mold. The wire is later etched away, or alternatively the diameter of the wire is reduced by tensive forces to allow its removal. Subsequent to casting the part corresponding to the composite 16 would be subjected to tests for absence of defects.

Regardless of the technique employed for making the assembly 16, oxygen-free, high conductivity copper or an aluminum dispersion enhanced copper (commerically available from the Gledden Co., Cleveland, Ohio) are preferred materials. The dispersion strengthened copper containing 0.15 percent by weight of aluminum in the form of $Al_2O_3$ with oxygen-free copper as the remaining constituent of the material has the advantage of staying hard after brazing. For the oxygen-free copper at least, an annealing process before and after machining is desirable to relieve stresses induced by the machining. The annealing should take place after the copper has been cleaned subsequent to the machining process and comprises an atmosphere of dry hydrogen at a temperature of 900° C. for 5 minutes with a cooling time of 30 minutes to room temperature.

The electron-beam tunnel 15 has a center line 0.125 inches from the edge 20 of the composite assembly 19. The alignment holes 27 allow precise alignment of the assembly 19 before cutting the slow-wave circuit to be described as well as for a subsequent braze step. The slow-wave circuit 30 is cut through the composite assembly 19 as shown in the plan view of FIG. 4. The circuit cut is made by a wire electric discharge machine. The cut is controlled to a tolerance of 50 millionth of an inch, non-cumulative, by use of a laser interferometer. The composite assembly 19 is bathed in the ionized water during machining to keep the assembly at a constant temperature as well as to flush away chips produced during the machining. The cutting electrode is a refractory wire about 0.003 inches in diameter. The composite assembly 19 is held on an XY table and the wire is played out from above from a supply above the table. The used wire is wound on another reel below the XY table and cannot be reused. An advantage of the electric discharge machine process is that it produces no machining stresses on the part being machined. RF conductivity of the slow-wave structure 30 is optimum on the stress-free surfaces.

An important part of the electrode discharge machine technique is obtaining good surface finish on the waveguide 30 cut. At the desired frequency of operation of 94 GHz, for example, an eight micro-inch current arithmetic mean stress-free surface is felt to be a specification for a good low-loss surface finish. The surface finishes are improved by using the following procedure for making the wave guide 30: First, making several undercut passes before the final full cut, removing only 50 millionths of an inch on the final cut; Secondly, during the final cut, using a constant pulse energy power supply instead of the customary capacitor bank power supply. The constant pulse energy supply controls the spark train that actually cuts the metal. The constant energy spark train will insure that the machine is cutting primarily via vaporization during the first part of the pulse and not via melting during the latter part of the pulse. Also, the energy in the arc is precisely controlled and not a function of the randomly varying voltage between the electrodes. Each new spark is not released until all the energy of the previous spark has been utilized. The burst of energy will occur at a more random rate, but each time the spark creates an electric current, the same amount of energy is released and the same amount of material is removed. Thirdly, the final and most expensive way to improve surface finish is to polish the part with a sinking electric discharge machine electrode after the wire cut is complete. The sinking electrode can be made of oxygen-free, high conductivity copper by a wire electric discharge machine step. Both the circuit and the electrode would polish at the same slow rate, only removing a few microinches of surface. Subsequent electropolish will also improve a surface finish.

The waveguide structure 31 which is machined in to the composite assembly 19 comprises the slow wave circuit 30 and a transition wave guide 32 which is a uniform taper in both depth and width in the center region 24 while tapering only in the width dimension in the region 25. The taper of transition wave guide 32 is terminated approximately midway between the edge 21 of the tunnel region 25 and the tunnel 15. A detailed view of the portion of the transition wave guide 32 at the region 33 where it joins the serpentine slow wave structure 30 is shown as section V—V of FIG. 4.

Figure 5:
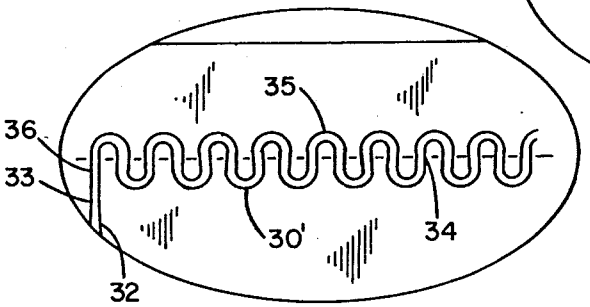

Referring to FIG. 5 there is a linear portion 34 which extends over the diameter of the tunnel 15. The width of the region 34 is typically 0.01 inches. The center-to-center spacing of the regions 34 is typically 0.025 inches with a full radius 35 joining the straight sections 34. The serpentine slow wave structure 30 is centered on the mean tunnel 15 axis within 0.001 inches. The total width of the waveguide is typically ten mils. The slow wave structure 30 has an end connected to an extension 36 of the same width as the portions 34 up to the region 33 where the transition with the tapered waveguide section 32 occurs.

Figure 6:
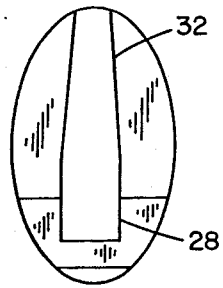
Figure 4:
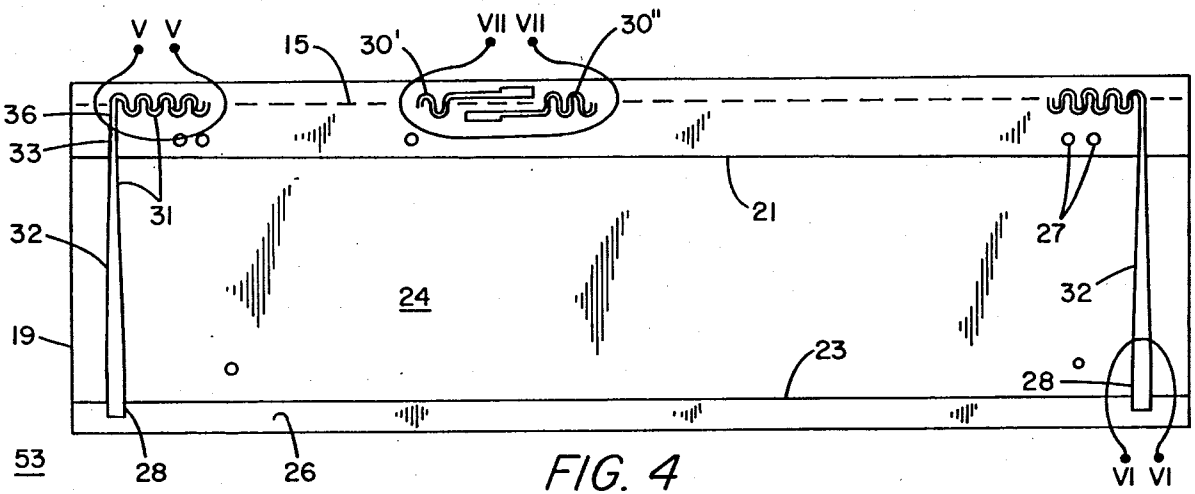
FIG. 4 is a planar view of the brazed assembly of FIG. 3 after machining the slow-wave circuit through the thickness of the brazed assembly.

Reference to FIG. 6 shows a detailed view of the section VI—VI of FIG. 4 which shows that the taper of the tapered transition wave guide 32 terminates at the line 23 and extends at a uniform width of 0.05 inches to within 0.079 inches of the 0.25 inch wide in region 26.

Figure 7:
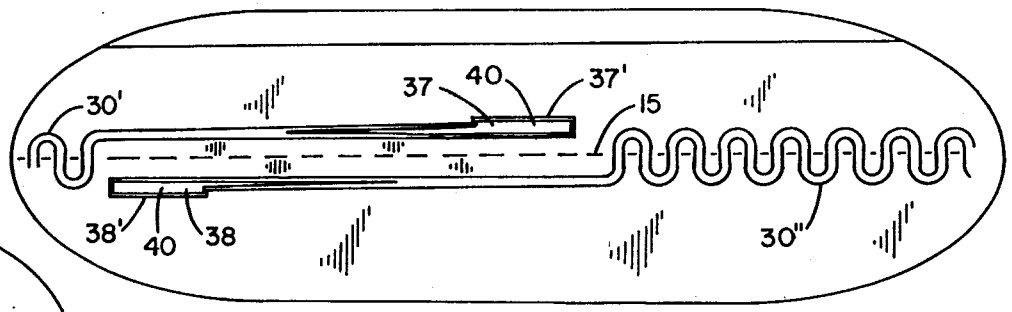
FIGS. 5, 6 and 7 are magnified views of FIG. 4 taken along section lines V—V, VI—VI, and VII—VII, respectively.
Figure 8A:
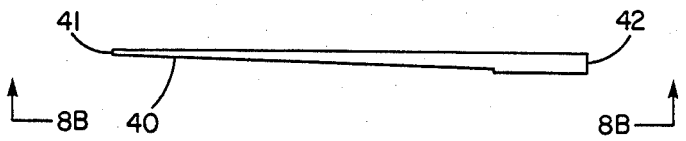
FIGS. 8A and 8B are side and top views, respectively, of the slow-wave circuit microwave absorber termination.
Figure 8B:
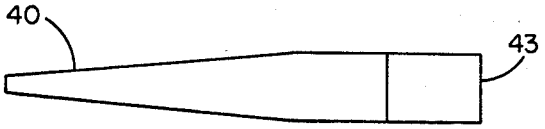

Isolation of the input slow wave circuit 30' from the output slow wave circuit 30'' is accomplished by providing a termination 37 for the input slow wave circuit 30' and a termination 38 for the output slow wave circuit 30''. The termination regions 37, 38 are shown with the microwave absorber 40, typically a lossy ceramic, which is shown in FIGS. 8A and 8B. The ridges 37' and 38' shown in FIG. 7 are dimensioned to snugly receive the termination 40. Typically the length of the ridge is 0.102 inches measured in the direction of the electron beam tunnel 15 with the dimension of the corresponding portion of the termination 40 being 0.100 inches. Referring to FIGS. 8A and 8B the termination 40 has a doubly tapered region which tapers in FIG. 8A from typically 0.015 inches to 0.005 inches in a distance of 0.36 inches typically. The other taper shown in FIG. 8B tapers from 0.067 at to 0.023 in a distance of typically 0.254 inches measured from the end 41. The thickness 42 of termination 40 is typically 0.02 inches and the width 43 is typically 0.067 inches.

It should be noted that the transition from the slow-wave circuit 30 waveguide to the standard waveguide input output transitions 60 were fabricated as an extension of the slow-wave circuit 30. There are no brazed or welded joints in these tiny wave guides 30, 32.

Figure 9:
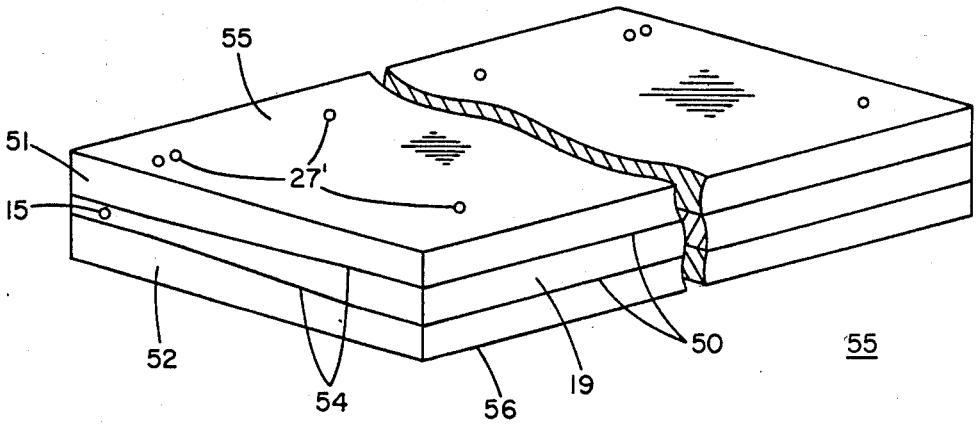
FIG. 9 is an isometric view of the brazed assembly of FIG. 4 brazed to top and bottom cover plates.

Referring now to FIG. 9 there is shown isometric view of a laminate brazed structure having as its center element the composite assembly 53. It is defusion brazed by gold foils 50 to a top cover plate 51 and a bottom cover plate 52. The top and bottom cover plates 51, 52 and the gold foils 50 have alignment holes 27' which correspond to the alignment holes 27 of the assembly 53. These alignment holes are utilized with a fixture to align the top and bottom cover plates 51 and 52, the gold foils 50 and the composite assembly 53 prior to an during brazing.

The surfaces 54 of circuit cover plates 51, 52 are highly polished because part of the cover forms the narrow waveguide wall of the circuit wave guide 30 and the transition 32. The polish also helps to maintain the uniformity of the braze across the entire area of the cover plates 51, 52. The gold foils 54 are cut almost exactly like the composite assembly 53 but slightly larger. Typically, the widths of the circuit cut in the gold foil is four thousandths of an inch wider than the width of the circuit cut in the assembly 19. The slightly over sized cut in the gold foils 54 prevents excessive solder fillet formation in the waveguide 30 corners after brazing. The fact that the brazing is also done below the melting temperature of gold (defusion brazing) will also preclude gold flow into the slow-wave structure 30. Note that because the gold foil is thin, typically 0.5 mil, it can easily be made using a numerically controlled laser cutter. For this application of cutting the waveguide structure and alignment holes in the gold foil the laser is much cheaper and superior to a wire electric discharge machining. With laser machining, the sheet is not subjected to water, and can be held flat with a glass slide. The edge burr characteristics of laser cuts will be of no consequence in this application.

The assembly 55 produced by the laminate braze is shown in FIG. 9. The assembly is aligned with pins through the alignment holes 27' and a weight of several pounds per square inch is placed on the top most plate 51 to speed the diffusion of the gold foil into the copper. This defusion braze is at the same temperature and for the same duration as the previous diffusion braze. The objective of the braze is to make a vacuum tight braze with no dimensional changes (the height of the laminate should be the same before and after the braze) and little gold flow is desired. The laminate is brazed in vacuum because the circuit contains the lossy microwave material 40 in the terminations 37, 38. After the braze the laminate assembly 55 is leak checked and X-rayed to check for gold solder balls in the slow-wave circuits 30', 30''. It should be noted that the taper of the surfaces 54 of the top and bottom cover plates 51, 52 are opposite in slope to that of the assembly 19 with the top and bottom surfaces 56, 57 thereby providing exterior parallel plane surfaces.

Figure 10A:
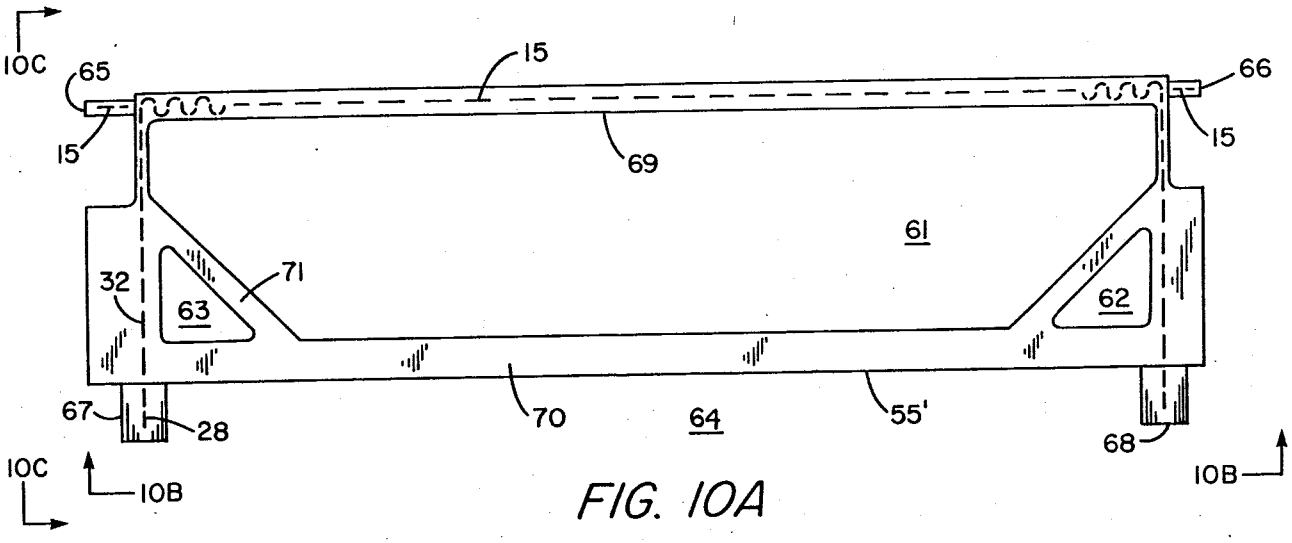
FIG. 10A is a planar top view of the slow wave structure of the invention.
Figure 10B:
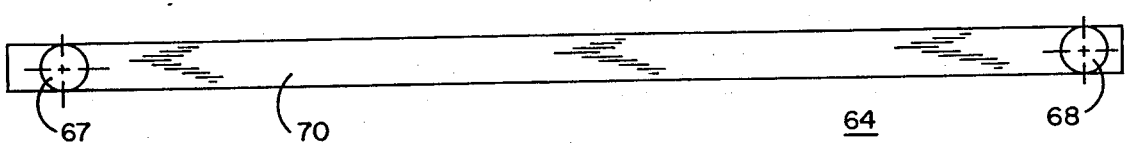
FIGS. 10B and 10C are end and side views of FIG. 10A taken along section lines 10A—10A, 10B—10B, respectively.
Figure 10C:
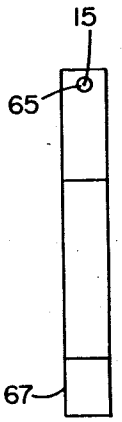

Referring now to FIG. 10A, there is shown a plan view of the composite laminate 55 of FIG. 9, after the laminate has been milled and lathed to eliminate much of the stock. Before machining, however, the tiny beam tunnel 15 ends are welded shut, gas tight, to prevent any machining oils from contaminating the internal passages. Note that only the first tunnel 15 opening to be welded can be leak checked because pumping can be done at the second opening. Then the regions 61, 62, 63 and 64 may be removed by conventional milling, but two special chucks are needed to hold the circuit 55' during lathe operations in making the cylindrical ends 65, 66 containing the tunnel 15. The other lathe operation is providing cylindrical protrusions 67, 68 which contain the non-tapered end 28 of the tapered waveguide section 32 described earlier. The cylindrical protrusions 67, 68 are centered on the center of the rectangular waveguide portion 28. The diameter of the cylindrical section 67, 68 is equal to the thickness of the laminate 55 which is typically 0.4 inches. The diameter of the cylindrical end 65, 66 containing the beam tunnel 15 is typically at 0.135 inches and extending 0.45 inches on the input end and 0.30 inches on the output end. The fragile circuit 55' which remains after these machining operations is supported by the thick bars 69, 70 and the diagonal member 71, each of which is 0.4 inch in thickness.

Figure 11A:
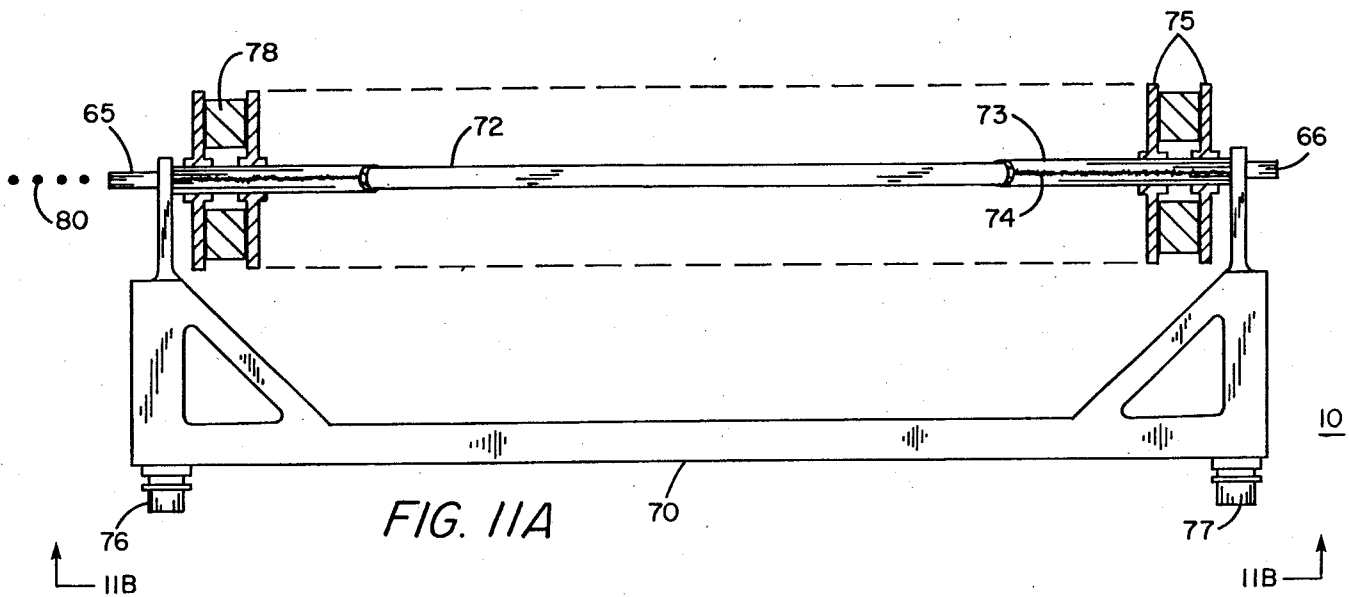
FIG. 11A is a planar top view of the slow-wave structure of the invention.
Figure 11B:
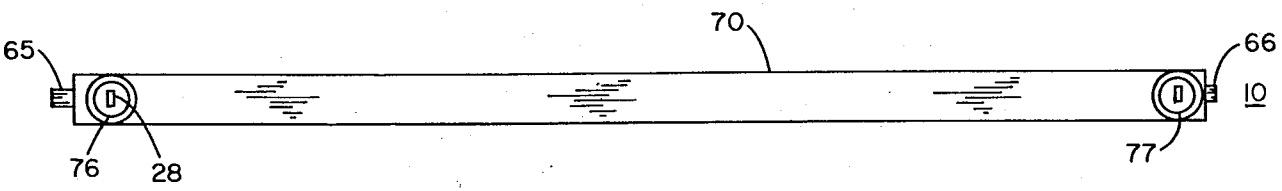
FIG. 11B is a side view of FIG. 11A taken along section lines 11B—11B.

The next step in the operation is to machine down the rectangular part 69 which contains the electron beam tunnel 15 and the slow-wave circuit 30 to a cylindrical shape such as shown in the plan and side views of FIGS. 11A, 11B, respectively. First, as much extraneous material as possible is milled away from the portion 69 of FIG. 10A, and then the rest is removed by a sinking electric discharge machine operation to obtain a round outer diameter for the portion 72 of FIG. 11A containing the beam tunnel 15 and a slow-wave circuit 30. The diameter is typically 0.135 inches. The cylindrical ends 65 and 66 are utilized in the machining operation because the cylindrical portion 72 is to be concentric with these ends. Since the cylindrical portion 72 containing the slow-wave structure 30 is long and thin and made of copper it does not have sufficient strength to withstand subsequent handling without modification. The use of the $Al_2O_3$ dispersion strengthened copper will be an advantage here. For this reason a thin longitudinally split stainless steel sleeve 73 is placed around the circuit structure 72 and electron beam welded to form the circular structure 73. The electron beam weld 74 is shown in FIG. 11. The stainless steel cylinder 73 supports the pole pieces 75 only a few which are shown in FIG. 11. The pole pieces 75 are disc shaped and are formed by welding together two halves of a disc to form a complete disc which is capable of freely rotating and sliding on the sleeve 73. This configuration allows a variety of PPM stacked configurations to be applied around the sleeve 73 to provide good beam transmission. The electron beam weld may be controlled to penetrate only the stainless steel sleeve 73 or the electron beam weld may slightly penetrate the copper circuit 72 to aid in heat transfer between the copper circuit 72 and the environment surrounding the sleeve 73.

Finally, the circuit 55' is placed back into the lathe. The circuit tunnel 15 is carefully reopened by removing the plugs at the ends of the cylindrical ends 65, 66. The ends of the standard waveguide cylinder 67, 68 are removed to expose the waveguide openings 28 to get the final precise alignment of the standard waveguide 28 to the window welding lip 76. The machining must be carefully done not to get chips or machining oil into the internal waveguide capacitor 28, and by having most of the stock removed before this step, only touch-up is required.

An electron beam 80 provided by a conventional traveling wave tube electron gun in a vacuum chamber with appropriate power supplies (all not shown) passes through tunnel 15 and is coupled to electromagnetic energy provided by slow-wave circuits 30', 30'' to provide amplification.

The physical dimensions discussed above were for 94 GHz operation. The dimensions could be easily scaled to build tubes in other microwave and millimeter wave frequency bands.

Figure 12:
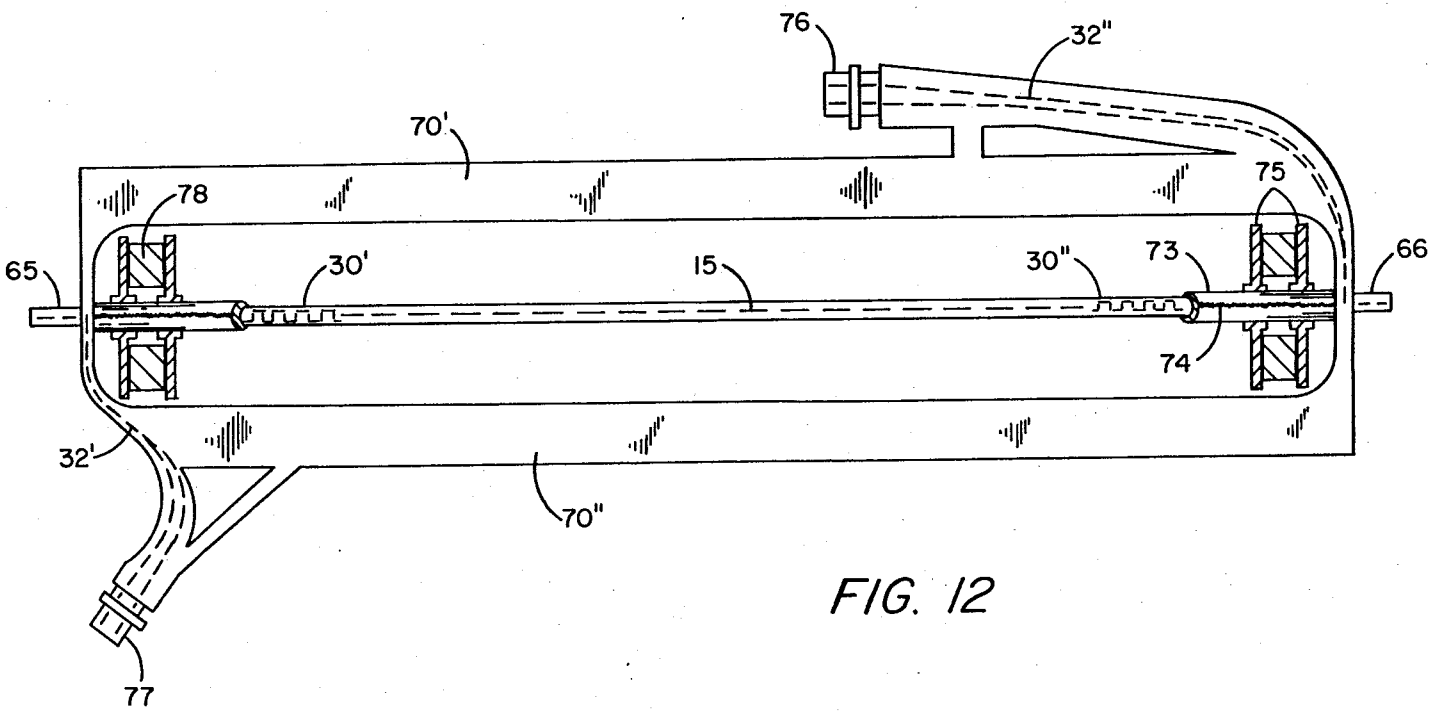
FIG. 12 is a planar top view of another embodiment of the slow wave structure of this invention.

Note that this technique allows a variety of transition shapes other than just perpendicular to slow-wave circuits 30', 30'' as in FIG. 11. FIG. 12 suggests some different transition shapes. In FIG. 12, the transition waveguides 32', 32'' are seen to be on opposite sides of the slow-wave waveguides 30', 30'', respectively. In addition, it is seen that the transition waveguides 32', 32'' are continuously tapered from the slow-wave structures to which they are connected to their respective output terminals 77, 76, respectively. The construction of the traveling wave tube of FIG. 12 is essentially the same as that by which the tube of FIG. 11A was obtained with machining modifications in the final steps of machining the output terminals 77 and 76 because of their different orientation on FIG. 12. Also, the transition sections 32', 32'', in addition to being linearly tapered, are also curved in order to allow the outputs 77 and 76 to be at an orientation other than perpendicular to the slow-wave circuits 30', 30''.

Having described a preferred embodiment of the invention, it will be apparent to one of skill in the art that other embodiments incorporating its concept may be used. It is believed, therefore, that this invention should not be restricted to the disclosed embodiment but rather should be limited only by the spirit and scope of the appended claims.

What is claimed is:

1. A traveling wave tube comprising:

a first circuit block;

an electron beam tunnel having an axis of symmetry in said circuit block;

a folded waveguide slow-wave circuit in said first circuit block having an axis of symmetry, an input, and an output;

said folded waveguide axis being parallel to said beam tunnel axis;

an input transition section of waveguide;

an output transition section of waveguide;

an input waveguide;

an output waveguide;

said input transition section of waveguide connecting said input of said folded waveguide and said input waveguide;

said output transition section of waveguide connecting said output of said folded waveguide and said output waveguide;

said folded waveguide, input and output transitions, and input and output waveguides each being in the form of a continuous slot in said first circuit block having two opposed walls;

said slot extending between first and second planar parallel opposed surfaces near one edge of said first circuit block; and a first and second cover plate attached to said first and second planar opposed surface of said circuit block to provide another two opposed walls of said folded waveguide, said input and output transitions, and said input and output waveguides.

2. The traveling wave tube of claim 1 wherein:

said electron beam tunnel extends longitudinally beyond and has an axis of symmetry coincident with the axis of symmetry of said folded waveguide slow-wave circuit;

said tunnel being contained within said first and second planar opposed surfaces of said first circuit block.

3. The traveling wave tube of claim 2 wherein:

said tunnel is cylindrical with a circular cross-section transverse to its longitudinal axis of symmetry.

4. The traveling wave tube of claim 1 wherein:

said first circuit block is comprised of a second and third circuit block, each having a semi-circular slot extending along and near said one edge thereof; and said second and third circuit blocks being attached to each other to form a cylindrical electron beam tunnel of circular cross-section.

5. The traveling wave tube of claim 4 wherein:

said first circuit block having third and fourth planar parallel opposed surfaces at an edge opposite said one edge and separated by a greater distance than said first and second planar opposed surfaces, said input and output waveguide slot being bounded by said third and fourth planar opposed surfaces; and said first circuit block having fifth and sixth planar opposed surfaces tapered between said first and third and said second and fourth opposed surfaces, respectively, said slot forming said transition sections of waveguide being bounded by said fifth and sixth surfaces.

6. The traveling wave tube of claim 4 comprising in addition:

a first gold foil between said second and third circuit blocks and attaching said second and third circuit blocks to form said first circuit block.

7. The traveling wave tube of claim 6 wherein:

said first gold foil comprises a fourth and fifth gold foil separated by said electron beam tunnel.

8. The traveling wave tube of claim 1 wherein:

said folded waveguide comprises a first and second folded waveguide;

one end of each said first and second folded waveguide being connected to said input and output transitions, respectively;

a first and second waveguide termination at the other end of each first and second folded waveguide, respectively.

9. The traveling wave tube of claim 1 comprising in addition:

a second and third gold foil between said first circuit block and said first and second cover plates, respectively, attaching said first and second cover plates to said first circuit block.

10. The traveling wave tube of claim 1 comprising in addition:

a portion of said first circuit block is cylindrical with an axis of symmetry coincident with that of said beam tunnel and slow-wave circuit;

said cylindrical portion of said circuit block having a cylindrical non-magnetic supporting jacket; and a plurality of permanent magnets and magnetic pole pieces.

11. The traveling wave tube of claim 1 wherein said first circuit block is high-electrical-conductivity oxygen-free copper.

12. The traveling wave tube of claim 11 wherein:

said copper comprises $Al_2O_3$ powder.

13. The traveling wave tube of claim 1 wherein:

said folded waveguide comprises an input and an output waveguide;

said input and output waveguides being separate waveguides each terminated in a microwave absorber near the center of said beam tunnel;

each said input and output waveguide being coupled to an electron beam in said beam tunnel for coupling electromagnetic energy into and out of said beam, respectively.

14. A method for fabricating a traveling wave tube comprising:

machining a semicircular groove near one edge of a first and second circuit block;

diffusion brazing said first and second circuit blocks with a gold foil to form a first composite structure having a circular cross-section electron beam tunnel formed of said semicircular grooves;

machining each of said first and second circuit blocks to uniformly reduce the thickness of each said block over a region extending transversely to said beam tunnel and over the length of said beam tunnel;

said machining providing a section of tapered thickness transverse to said beam tunnel between the innermost portion of said region toward the opposite edge of said composite structure leaving a region transverse to said opposite edge and extending over the length of said composite structure of the original thickness of said composite structure;

machining a slow-wave pattern slot centered on said electron beam tunnel, said slow-wave slot extending through said thickness of first composite structure;

said machining of said slow-wave pattern slot including machining an input and output transition section slot as an extension of said slow-wave pattern slot, said transition section slot extending through the thickness of said first composite structure;

said composite structure having a thickness corrresponding to the widest internal dimension of standard waveguide;

machining a first and second cover plate with a taper and thin and thick edge regions complementary to that of said machined first composite structure;

machining a slow-wave pattern in a second and third gold foil to match that in said first composite structure;

brazing said first composite structure to said first and second cover plates with said second and third gold foils, respectively, to form a second composite structure;

machining said second composite structure to remove material from regions surrounding said slow-wave circuit and said transition sections to provide a cylinder centered on said electron beam tunnel and cylinders centered on said input and output waveguides.

15. The method of claim 14 comprising in addition:

precision grinding of said first and second circuit block surfaces;

polishing at least one surface of each of said first and second circuit blocks;

machining alignment holes into said first and second circuit blocks; and sinking electric discharge machining for said machining of a semicircular groove in each of said first and second circuit block polished surfaces using said alignment holes to precisely position said groove on each of said first and second circuit blocks.

16. The method of claim 14 wherein:

said machining of a slow-wave pattern comprises machining by a wire electric discharge machine whose position relative to said first and second circuit blocks is controlled by a laser interferometer.

17. The method of claim 14 wherein:

said brazing of said first composite structure to said first and second cover plates to form a second composite structure is a diffusion braze.

18. The method of claim 14 including:

inserting a microwave absorber into said slow-wave pattern slot prior to brazing said first composite structure to said first and second cover plates.

19. The method of claim 14 comprising in addition:

electron beam welding of semi-circular cylinders of stainless steel around said cylinder centered on said electron beam tunnel; and applying circular magnetic pole pieces and circular magnets along said stainless steel cylinder to provide a distributed axial magnetic field within said beam tunnel.

* * * * *